US005534839A

United States Patent [19]

Mackin et al.

[11] Patent Number: 5,534,839

[45] Date of Patent: Jul. 9, 1996

[54] MINIATURE TRANSFORMER

[75] Inventors: Sean M. Mackin, Wauwatosa; Jeffrey D. Brown, Port Washington, both of Wis.

[73] Assignee: Cramer Coil & Transformer Co., Inc., Saukville, Wis.

[21] Appl. No.: 417,002

[22] Filed: Apr. 5, 1995

[51] Int. Cl.[6] ..... H01F 15/10; H01F 27/30

[52] U.S. Cl. ..... 336/192; 336/198

[58] Field of Search ..... 336/198, 208, 336/192, 65

[56] References Cited

U.S. PATENT DOCUMENTS

| | | | |
|---|---|---|---|
| 3,958,328 | 5/1976 | Lee | 29/605 |
| 4,250,479 | 2/1981 | Bausch et al. | 336/208 |
| 4,363,014 | 12/1982 | Leach et al. | 336/90 |
| 4,857,878 | 8/1989 | Eng, Jr. et al. | 336/192 |
| 4,916,424 | 4/1990 | Kijima | 336/160 |
| 4,939,494 | 7/1990 | Masuda et al. | 336/198 |
| 4,944,975 | 7/1990 | Sheer | 428/36.1 |

FOREIGN PATENT DOCUMENTS 479758 8/1975 Australia .

59-51508 3/1984 Japan .

OTHER PUBLICATIONS

IBM Technical Disclosure Bulletin, "Bobbin Set for a Low Profile, Safety Approved Transformer," vol. 30, No. 11, Apr. 1988, copy in 336–198.

4 Series 34 ETD Cores.

E 30 Schutzklasse.

*Primary Examiner*—Thomas J. Kozma
*Attorney, Agent, or Firm*—Michael, Best & Friedrich

[57] ABSTRACT

A miniature transformer for use with printed circuit boards includes a winding assembly comprising a first tubular bobbin having a first winding thereon, and second and third tubular bobbins each having a winding thereon and being received, respectively, in the open opposite ends of the first bobbin. A shell member is received over the winding assembly and engages the ends of the second and third bobbins for holding the same within the first tubular bobbin. There are a pair of E-shaped core members each having a center leg received in the open ends of the second and third bobbins and side legs received in a gap between the shell member and the winding assembly.

12 Claims, 2 Drawing Sheets

MINIATURE TRANSFORMER

BACKGROUND OF THE INVENTION

This invention relates to transformers and more particularly to miniature transformers for use with printed circuit boards.

Transformers for use with printed circuits must be small in size and yet satisfy power requirements with safety and reliability. For example, the input voltage power transformer of a flyback power supply may be in the order of 900 volts at a total power output of 7 watts. Notwithstanding the small size, the spacing in such transformers must satisfy safety requirements. Moreover, economy and ease of manufacture are important considerations in the design of such transformers.

SUMMARY OF THE INVENTION

It is the primary object of the invention to provide new and improved miniature transformers for printed circuit boards.

A further object of the invention is to provide miniature transformers for printed circuit boards which are formed of modular components.

Another object of the invention is to provide miniature transformers for printed circuit boards which are easy and inexpensive to manufacture and assemble.

A still further object of the invention is to provide a miniature transformer for printed circuit boards which satisfies international safety spacing standards.

These and other objects and advantages of the present invention will become more apparent from the detailed description thereof taken with the accompanying drawings.

In general terms the invention comprises a miniature transformer for use with printed circuit boards including a winding assembly comprising a first tubular bobbin having at least one end opening, a first winding disposed on the first bobbin, a second tubular bobbin, a second winding disposed on the second bobbin. The second tubular bobbin is telescopically received within the end opening of the first tubular bobbin and a shell receivable over the first bobbin and includes a locking portion for retaining the second bobbin within the end opening of the first bobbin.

DESCRIPTION OF THE PREFERRED EMBODIMENT

Figure 1:
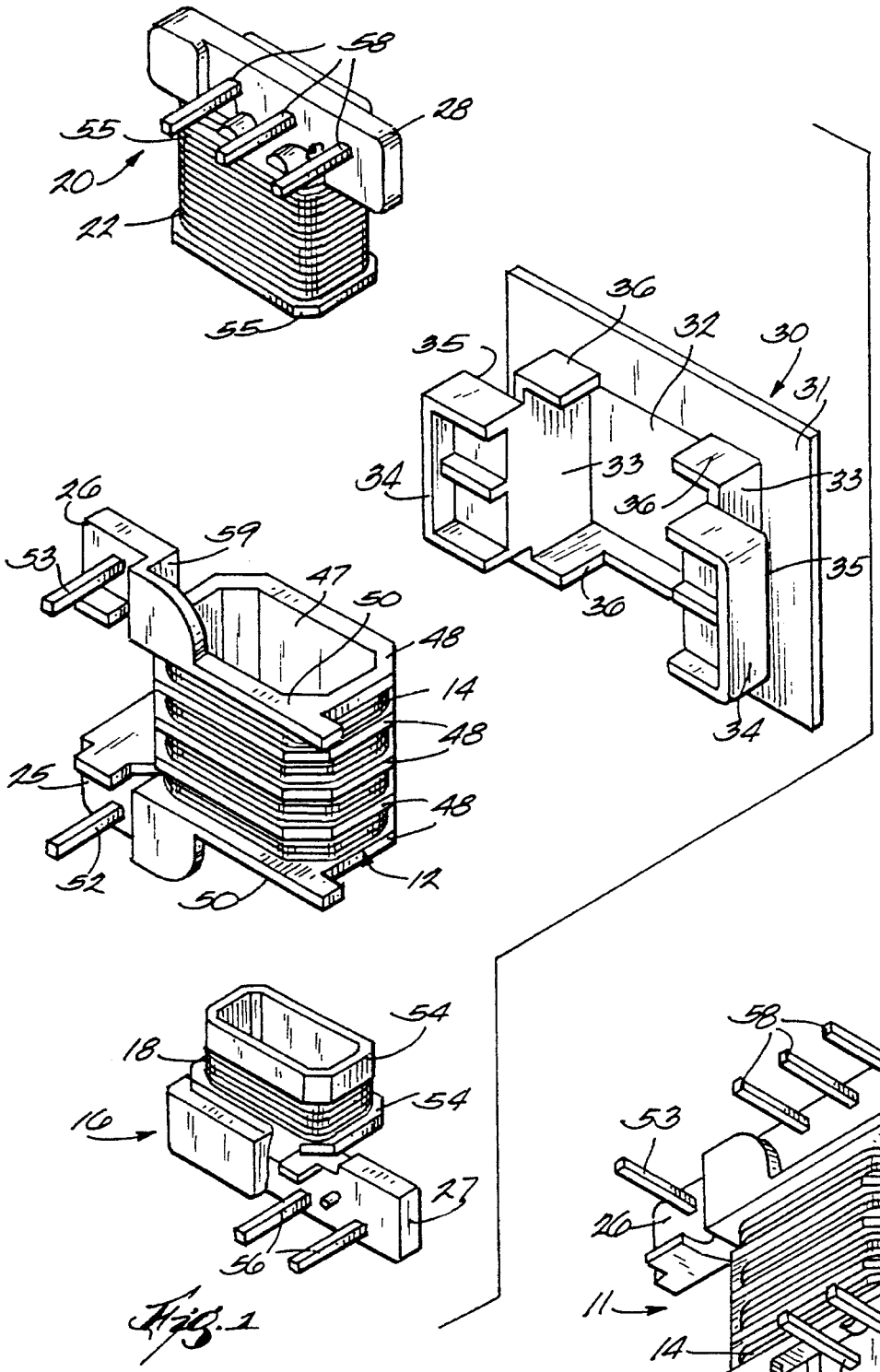
FIG. 1 is an exploded perspective view showing a portion of the transformer according to a preferred embodiment of the invention.
Figure 2:
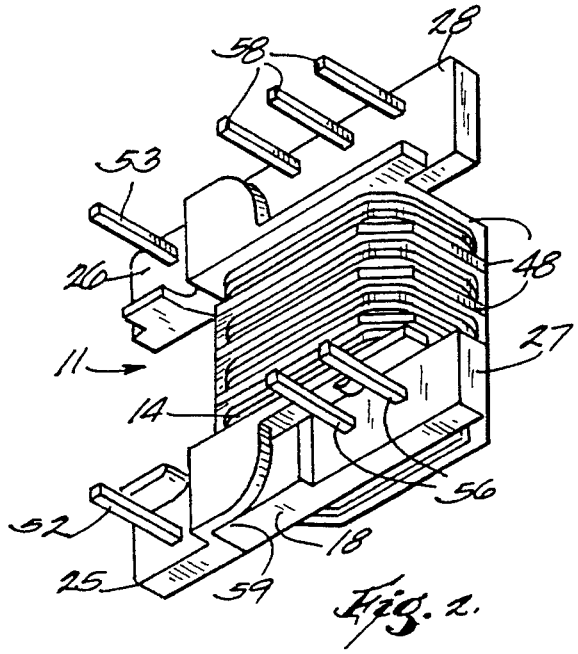
FIG. 2 is a perspective view showing the winding assembly portion of the preferred embodiment of the invention.

The miniature transformer 10 according to the preferred embodiment of the invention is shown in the drawings to include a winding assembly 11 shown in FIGS. 1 and 2 to comprise a first tubular, open ended, bobbin 12 having a first winding 14 of a fine gauge wire wound thereon; a second tubular bobbin 16 having a second winding 18 of a fine wire wound thereon; and a third tubular bobbin 20 having a third winding 22 of a relatively fine wire wound thereon. The wire size for windings 14, 18 and 22 may be, for example, in the order of about 30–40 awg. The second and third bobbins 16 and 20 are received in the opposite open ends of the first bobbin 12 to provide the winding assembly 11 shown in FIG. 2. As will be discussed more fully below, the first bobbin 12 has a pair of pin supports 25 and 26 at its upper and lower ends which align respectively with an integral flange member 27 and 28 on bobbins 16 and 22, respectively. This provides parallel, spaced apart flanges 25, 27 and 26, 28 at the upper and lower ends of the winding assembly 11.

A shroud member 30 is shown in FIG. 1 to include a rectangular flange 31 which surrounds a rectangular center opening 32. At the sides of opening 32 and extending toward one side thereof, there are a pair of parallel side walls 33 spaced apart a distance equal to the width of the bobbin 14. The height of the opening 32 is slightly larger than the height of bobbin 14 so that the bobbin will be received within opening 32 and between the side walls 33. At the side of each wall 33 and opposite the flange 31, there is an outwardly extending member 34 each having a planar surface 35 which is parallel to the flange 31. The gap between the flange 31 and the members 35 is slightly larger than the width of core pieces 44 and 46. Extending inwardly from the upper and lower ends of members 33 are pairs of tabs 36.

When assembled, the coil assembly 11 is received within the opening 32 in shroud member 30 and between the walls 33 and the tabs 36. Moreover, the tabs 36 extend over the edges of the bobbins 12, 16 and 20 to lock the bobbins 16 and 20 in place within the bobbin 12. In addition, the upper and lower portions of the flange 31 are spaced from the flanges 25, 27 and 26, 28 and the side members 36 are received in the gaps between flanges 25, 27 and 26, 28. This defines a gap 43 surrounding the assembly for receiving E-shaped core pieces 44 and 46.

The first bobbin 12 is hollow and has an inner surface 47 which is generally rectangular in cross section with beveled corners. A plurality of equally space apart, parallel ribs 48 extend around the circumference of bobbin 12 for maintaining the winding capacitance and corona reliability. The pin supports 25 and 26 extend axially from the opposite ends of bobbin 12 and each includes a notch 49 for receiving the end of the flanges 27 or 28 on the bobbins 16 and 20, respectively. Formed adjacent each pin support 25 and 26 and extending along one edge of bobbin 12 beyond the periphery thereof are a pair of thin support members 50. The members 50 provide supports for the flanges 27 and 28 of bobbins 16 and 20 and define the gap for receiving one of the members 35 on shell 31. Surfaces 51 and 52 on pin supports 25 and 26, respectively, are spaced to receive the member 35 at the opposite side of the shell 31. At least one electrically conductive pin 53 extends perpendicularly from each pin support 25 and 26 and each is suitably connected to one of the opposite ends of winding 14.

The bobbin 16 includes a generally tubular body having upper and lower ribs 54 between which the winding 18 is wound. The ribs 54 are configured complementary to the inner surface 47 of the bobbin 12 so that bobbin 16 is received with a sliding fit therein. The bobbin 20 also includes ribs 55 which are configured complementary to the inner surface 47 of the bobbin 16 so that it too is received with a sliding fit within bobbin 12. Two electrically conductive pins 56 extend from flange 27 and are connected to the opposite ends of winding 18 while in the illustrated embodiment, winding 20 is tapped so that three pins 58 are mounted on flange 28.

The bobbins 12, 16 and 20 and the shroud 30 are formed of any suitable electrical insulating material that can readily be molded, such as thermoplastic polyester (PET). Thus, the ribs 48 at the upper and lower ends of bobbin 12, the ribs 54 on bobbin 16 and the ribs 55 on bobbin 20, as well as the bobbin 12 itself, provide the necessary electrical insulation between windings 14, 18 and 22 without the necessity for other insulation.

As seen in FIGS. 1 and 2, the flanges 27 and 28 are received within the notches 59 and rest against the upper and lower ribs 48 of bobbin 12 to form extensions of the flange 26 and 27.

The core pieces 44 and 46 have an E-shape as defined by a central leg 60, a pair of side legs 62 and connecting legs 64. Those skilled in the art will appreciate that the core pieces 44 and 46 may be formed of any suitable ferromagnetic material.

In assembly, the bobbins 16 and 20 are inserted into the lower and upper ends of the bobbin 14. The flanges 27 and 28 limit the depth to which bobbins 16 and 20 can be inserted so that the lower rib 54 on bobbin 16 and the upper rib 55 on bobbin 20 are aligned with the open lower and upper ends of bobbin 12. This provides the winding assembly 11 shown in FIG. 2.

Figure 3:
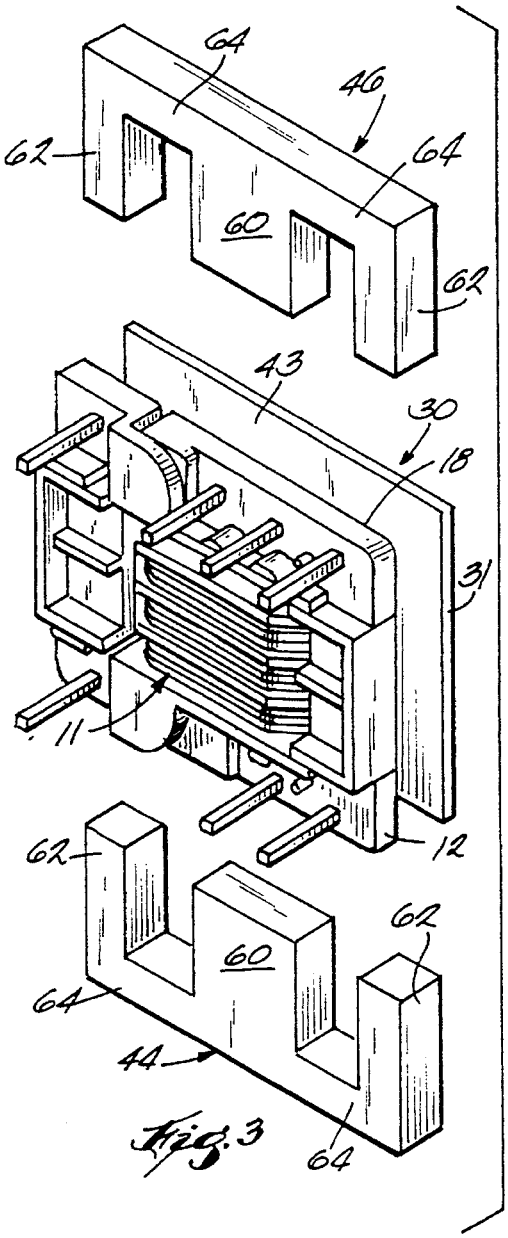
FIG. 3 is an exploded perspective view showing the coil assemblies and the core pieces of the preferred embodiment of the invention.
Figure 4:
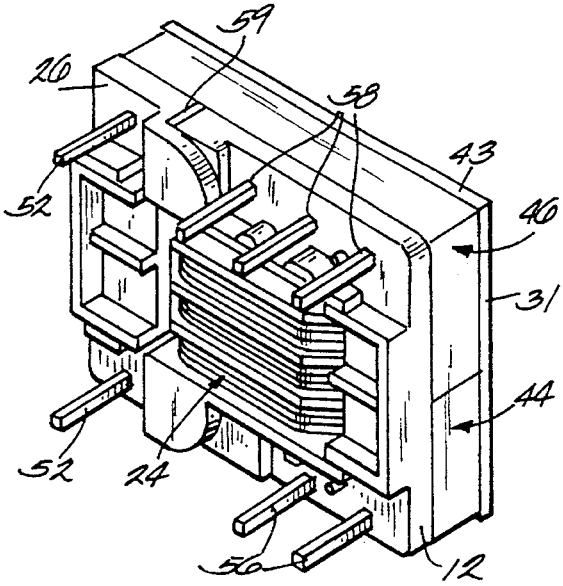
FIG. 4 is a perspective view of the transformer according to the preferred embodiment of the invention.

The shroud member 30 is then positioned over the winding assembly 11 so that the sides of bobbin 12 are received between the side walls 33 and within the opening 32. In addition, the tabs 36 are positioned over the upper and lower ends of bobbin 12 so that their edges engage the flanges 27 and 28 and their inner surfaces are positioned over the ends of bobbin 12 to lock the bobbins 16 and 20 in position. When the tabs 36 engage the flanges 27 and 28, the width of the gap between the flange 31 on shroud 30 and the flanges 25, 27 and 26, 28 is also defined. The gap between the inner edges of the tabs 36 are slightly larger than the width of the central leg 60 of core pieces 44 and 46. In addition, the width of the tabs 36 is slightly less than the distance of the inner surfaces of the outer legs 64 and the inner leg 60 of core pieces 44 and 46. As a result, the core pieces 44 and 46 are receivable in the combined winding and shell assembly shown in FIG. 3 with the center legs 60 being receivable within the gaps between tabs 36 and into the coil assembly 11 and with the outer legs 60 being received in the gaps between flange 31 and members 35 of shell member 30. The inner ends of the legs 60 and 62 of core pieces 44 and 46 abut to provide a closed loop magnetic circuit around coils 14, 18 and 22. The core can then be held together by an adhesive material applied to the engaging portions of the side legs 60 of core pieces 44 and 46. This provides a compact, easy to assemble transformer suitable for use with a circuit board and not requiring insulation other than the modular components.

The shroud 30 performs the functions of holding the coil assembly together, insure proper alignment of the pins 52, 56 and 58 and provides sufficient creepage distance between the core pieces 44 and 46 and the windings 14, 18 and 22, and also between the windings themselves, to satisfy international safety regulations.

The transformer according to the preferred embodiment of the invention provides such sufficient creepage distance to satisfy international safety standards despite its relatively small size. For example, in one embodiment the height and width were about 0.7"×0.82".

While only a single embodiment of the invention is illustrated and described, the invention is not limited thereby, but only by the scope of the appended claims.

We claim:

1. A miniature transformer for use with printed circuit boards includes a winding assembly comprising a first tubular bobbin having at least one end opening, a first winding disposed on the first bobbin, a second tubular bobbin, a second winding disposed on the second bobbin, said second tubular bobbin being telescopically received within the end opening of the first tubular bobbin, and shroud means receivable over said first bobbin and including a locking portion for retaining said second bobbin within the end opening of said first bobbin, a first core receiving portion formed on said winding assembly and a second core receiving portion is formed on said shroud means, said first and second core receiving portions being disposed in a spaced apart relation, and a core receivable between said first and second core receiving portions and defining a magnetic circuit with respect to said first and second windings, said first and second core receiving portions including flange means for separating said core from said first and second windings.

2. The transformer set forth in claim 1 wherein said first tubular bobbin is open at its opposite ends, said second bobbin being received in one open end of said first bobbin, a third bobbin, a third winding disposed on said third bobbin, said third bobbin being received in the other open end of said first bobbin, said shroud means including a second locking portion for retaining said third bobbin within said first bobbin.

3. The transformer set forth in claim 2 wherein a first core receiving means are formed on said winding assembly, said shroud means being slidably received on said winding assembly and including second core receiving means, said core comprising first and second core members each having a center leg receivable in one of the opposite ends of said first bobbin and having side legs disposed between said core receiving portions.

4. The transformer set forth in claim 3 wherein the side legs of the first core member are secured to the side legs of said second core member for locking said shroud means to said winding assembly and for preventing the removal of the second and third bobbins from said first bobbin.

5. The transformer set forth in claim 2 wherein said second and third bobbins are slidably received within said first bobbin, said bobbins being formed of an electrically insulating material and being the sole insulation between said windings.

6. The transformer set forth in claim 5 wherein each of said second and third bobbins are configured complimentary with the opening in said first bobbin and each bobbin having rib means defining the margins of each coil to provide electrical insulation at the ends of each coil.

7. The transformer set forth in claim 6 wherein there is a flange at each end of the coil assembly for supporting electrically conductive pins for connection to a circuit board, said flanges defining the core receiving portion on the winding assembly.

8. The transformer set forth in claim 7 wherein said shroud means has an opening formed therein, the core receiving means on the shroud means comprising a flange surrounding said opening, said winding assembly being receivable within said opening.

9. The transformer set forth in claim 8 and including a pair of core members each having a center leg receivable in one of the open ends of said winding assembly and a pair of side legs being receivable between the flanges on the coil assembly and said shroud means.

10. The transformer set forth in claim 7 wherein a first core receiving means are formed on said winding assembly, said shroud means being slidably received on said winding assembly and including second core receiving means, said core comprising first and second core members each having a center leg receivable in one of the opposite ends of said first bobbin and having side legs disposed between said core receiving portions.

11. The transformer set forth in claim 10 wherein the side legs of the first core member are secured to the side legs of said second core member for locking said shroud means to said winding assembly and for preventing the removal of the second and third bobbins from said first bobbin.

12. The transformer set forth in claim 10 wherein said shroud means has an opening formed therein, the core receiving means on the shroud means comprising a flange surrounding said opening, said winding assembly being receivable within said opening.

* * * * *